US005273183A

United States Patent [19]

Tuttobene

[11] Patent Number: 5,273,183

[45] Date of Patent: Dec. 28, 1993

[54] ARTICLE VENDING MACHINE

[76] Inventor: Philip Tuttobene, 1002 Magnolia #30, Anaheim, Calif. 92801

[21] Appl. No.: 839,471

[22] Filed: Feb. 18, 1992

[51] Int. Cl.[5] ..... G07F 11/00

[52] U.S. Cl. ..... 221/7; 221/8; 221/13; 221/76; 221/121; 235/381; 414/274

[58] Field of Search ..... 221/2, 7, 8, 13, 76, 221/113, 119-122; 414/274, 331; 235/381

[56] References Cited

U.S. PATENT DOCUMENTS

| | | | |
|---|---|---|---|
| 1,344,160 | 6/1920 | Wright | 221/120 |
| 2,819,814 | 1/1958 | Hatch | 221/121 |
| 3,297,379 | 1/1967 | Artaud et al. . | |
| 3,526,326 | 9/1970 | Castaldi . | |
| 3,964,577 | 6/1976 | Bengtsson . | |
| 4,300,040 | 11/1981 | Gould et al. . | |
| 4,414,467 | 11/1983 | Gould et al. . | |
| 4,458,802 | 7/1984 | Maciver et al. . | |
| 4,519,522 | 5/1985 | McElwee | 221/13 |
| 4,546,901 | 10/1985 | Buttarazzi . | |
| 4,598,810 | 7/1986 | Shore et al. . | |
| 4,599,522 | 7/1986 | Matsuo et al. . | |
| 4,668,150 | 5/1987 | Blumberg . | |
| 4,681,504 | 7/1987 | Welch, Sr. . | |
| 4,734,005 | 3/1988 | Blumberg . | |
| 4,812,629 | 5/1989 | O'Neil et al. . | |
| 4,814,592 | 3/1989 | Bradt et al. . | |
| 4,824,311 | 4/1989 | Mims . | |
| 4,839,875 | 6/1989 | Kuriyama et al. . | |
| 4,903,815 | 2/1990 | Hirschfeld et al. . | |
| 4,988,186 | 1/1991 | Hill et al. | 351/239 |
| 5,020,958 | 6/1991 | Tuttobene . | |
| 5,042,686 | 8/1991 | Stucki | 221/13 |

*Primary Examiner*—H. Grant Skaggs
*Attorney, Agent, or Firm*—Hawes & Fischer

[57] ABSTRACT

An improved article handling system includes an article storage structure for containing articles to be handled, transport structure for transporting articles to a position where they can be delivered to or removed from machine, control devices to identify, remove and deliver article to said storage bins, a record keeping device for recording each transaction of the system including dispensing, retrieval and identification of the article and user. The construction and arrangement of the transport means for transporting articles to the dispense and/or return position is unique in its construction, its two axes of motion is performed using one motor allows this article vending machine to be constructed very efficiently and at a very reliable cost. Further, The article vending machine is capable of identifying articles for return prior to their insertion into the machine.

14 Claims, 13 Drawing Sheets

FIG. 6a
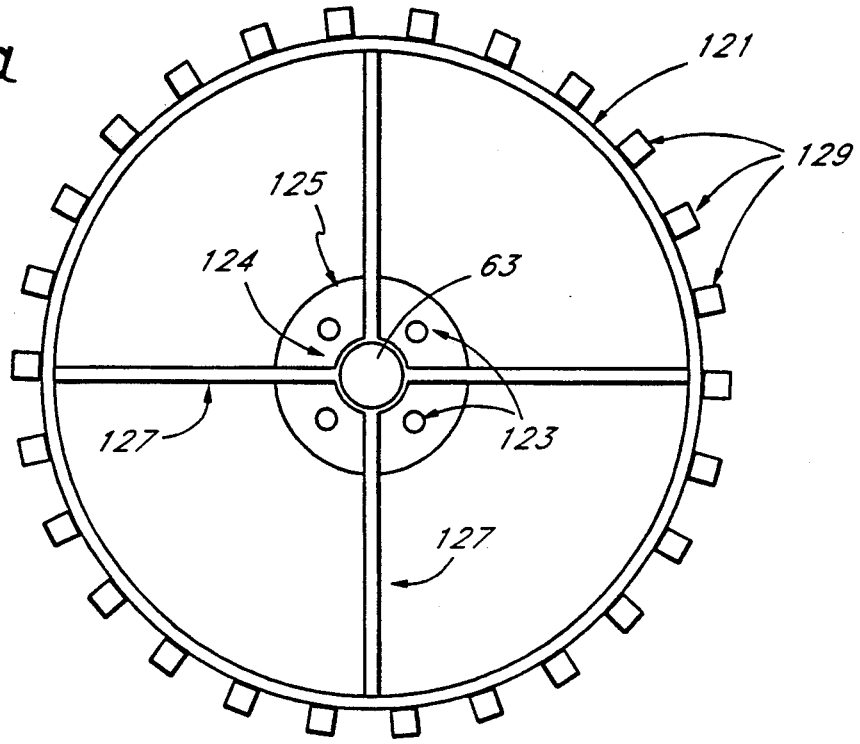
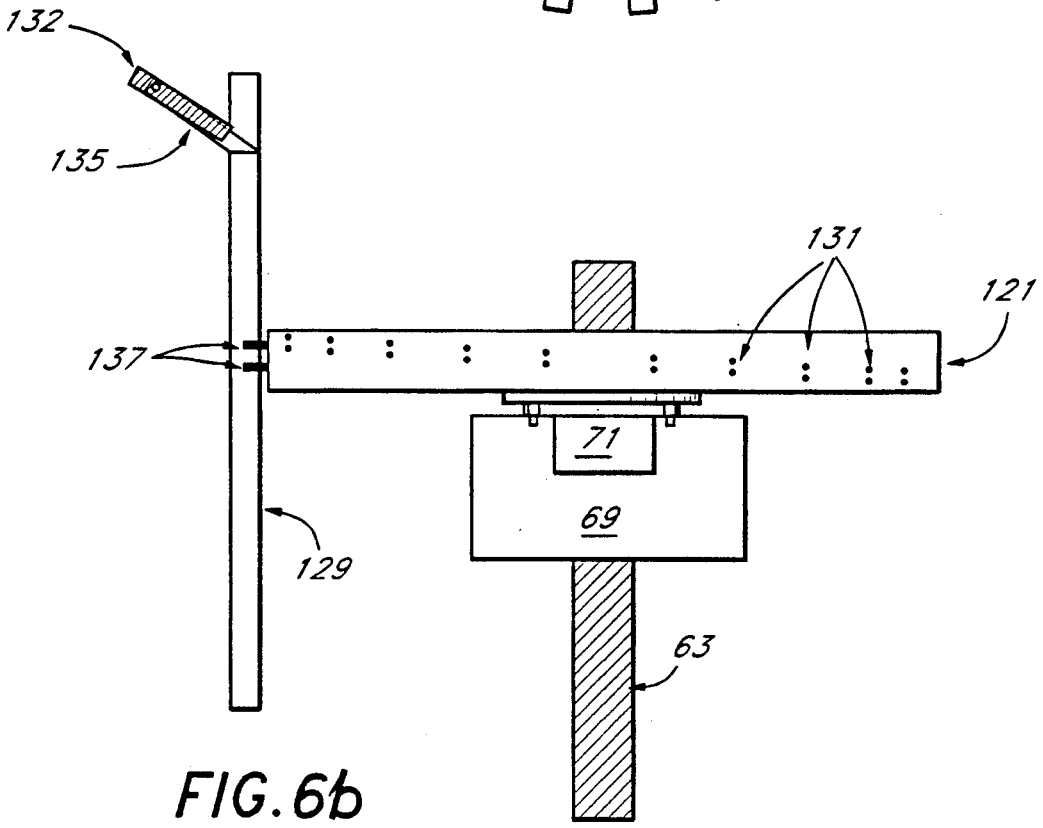
FIG. 6b

ARTICLE VENDING MACHINE

BACKGROUND OF THE INVENTION

The invention relates to an automated article handling system and more particularly to improvements over existing automated handling systems relating to the rental dispensing of consumer goods, especially copyrightable works such as cassette video tapes, laser disks, game cartridges and the like.

The popularity of purchased electronically utilizable copyrighted works, hereinafter consumer goods, in both the purchased and rental markets is increasing. Until recent times, these consumer goods, and in particular video cassettes were available only in manned video stores. These stores are expensive to operate due to significant overhead, including unit costs in labor and utilities. The unit costs coupled with long operating hours of up to 16 or more hour daily for seven days per week significantly contribute to operating overhead.

The availability of an automated video vending machine of sufficient capacity, if produced and sold economically could drastically reduce this overhead and dramatically increase consumer goods profits to the owner of such device. Such an automated vending machine with a large capacity of videos cassettes, could eliminate the costly manned stores, and, since it would be totally automated, it would operate on a 24 hour per day basis.

Several video cassette rental devices are known in the market. A typical video vending machine includes (1) a capability of receiving cash or credit from customer using a cash verification machine or credit/bank automatic teller machine card verification debit system; (2) a keypad for customer-operator to input a personal identification number and for a customer to select and identify a cassette for rental or return; (3) a display to prompt the customer-operator through the rental or return transaction; (4) an apparatus for vending, or changing the custody of the selected consumer good to and from the customer-operator; and (5) and record keeping means for recording all transaction parameters including identity of the consumer good, identity of the customer, the time, date, revenue of the transactions, etc.; (6) an apparatus for dispensing a transaction receipt to customer Examples of such video cassette vending machines are described in U.S. Pat. Nos. 4,414,467, 4,598,810, 4,734,005 and 4,458,802. U.S. Pat. No. 4,598,810 discloses a video cassette vending machine in which the cassettes are stored in bins that open to the front of the machine, and are directly accessible to customer-operator The video cassettes in the bins are individually locked against removal, the customer-operator selected bin allowed to open only after the customer satisfies all machine prompted tasks in his transaction. During the transaction, the video cassette tape upon rental is removed from and upon return is inserted directly into the bin.

Another type of cassette vending machine shown in U.S. Pat. No. 4,598,810 has moveable storage bins enclosed within a machine's housing. A transport mechanism is utilized to align the moveable storage bin with an opening to deliver a cassette to a customer-operator. This same mechanism enables the return of the cassette from the customer-operator to a storage bin. U.S. Pat. No. 4,734,005 illustrates a device similar to this type of machine.

Other patent references reveal a vast assortment of patents showing similar automatic article handling systems or machines with storage systems such as file containers, security boxes and the like. Such patent references include U S. Pat. Nos. 3,297,379, 3,526,326, 3,964,577, 4,300,040, 4599,522, 4,546,901, and 4,681,504.

The mechanisms utilized in all of the above references require somewhat complex mechanical and electrical systems, tending to increase the cost of manufacturing these devices

SUMMARY OF THE INVENTION

This invention provides an improved article handling system of that described in any of the above patents The article handling system comprises of a) article storage structure for containing articles to be handled, (b) transport structure for transporting articles to a position where they can be delivered to or removed from machine (c) control devices to identify, remove and deliver article to said storage bins. (d) a record keeping device for recording each transaction of the system including dispensing, retrieval and identification of the article and user.

One important feature of the article handling system is the construction and arrangement of the transport means for transporting articles to the dispense and/or return position This transport means is unique in its construction mainly since two axes of motion is performed using one motor This motor forms an assembly which is the only moving part utilized in the transport of the articles to be vended The absence of any gears, belts, cables, chains, claws, jaws, grippers or any other mechanical apparatus allows this article vending machine to be constructed very efficiently and at a very reliable cost.

In addition, the article vending machine is capable of identifying articles for return prior to their insertion into the machine. This improvement over other machines, which require insertion of the article before its identification, will minimize vandalism and eliminate machine operation under conditions where articles are not being returned, such as attempts to get inside the machine for vandalism, or theft. Since an unidentified article is never "accepted", it will never have to be "rejected" in some manner. The vending machine described and claimed herein permits up to four users to access the machine simultaneously. With multitasking software, all transactions can be entered together. Articles will be dispensed or returned on a first come first serve basis.

BRIEF DESCRIPTION OF THE DRAWINGS

Other aspects, features and advantages of the invention, its configuration, construction, and operation will be best understood from the following detailed description, taken in conjunction with the accompanying drawings in which:

FIG. 4(*b*) is a partially cut away side sectional view of the motor of FIG. 4(*a*);

FIG. 4(*c*) is a view of the bottom surface of the brushless DC motor shown in FIGS. 4(*a*) and 4(*b*);

FIG. 5(*b*) is a partially cut away side sectional view of the motor of FIG. 5(*a*);

FIG. 5(*c*) is a view of the bottom surface of the brushless DC motor shown in FIGS. 5(*a*) and 5(*b*);

FIG. 6(*a*) illustrates a top view of a tape hub which is affixed to the rotor of the motor illustrated in FIGS. 4 (*a*) and 4(*b*);

FIG. 6(*b*) illustrates a plan view of the tape hub which was illustrated in FIG. 6(*a*);

FIG. 7(*b*) is a front view of a single shelf;

FIG. 7(*c*) is a detail of a row of shelves for each single shelf support rail;

FIG. 7(*d*) is a back view of a single shelf attached to a shelf support;

FIG. 9(*b*) is a front view of the tape door of FIG. 9(*a*);

FIG. 12(*b*) is a detailed perspective view to illustrating the dual identification structures on an article to be returned, employable for validating consumer goods;

DETAILS OF PREFERRED EMBODIMENTS

Figure 1:
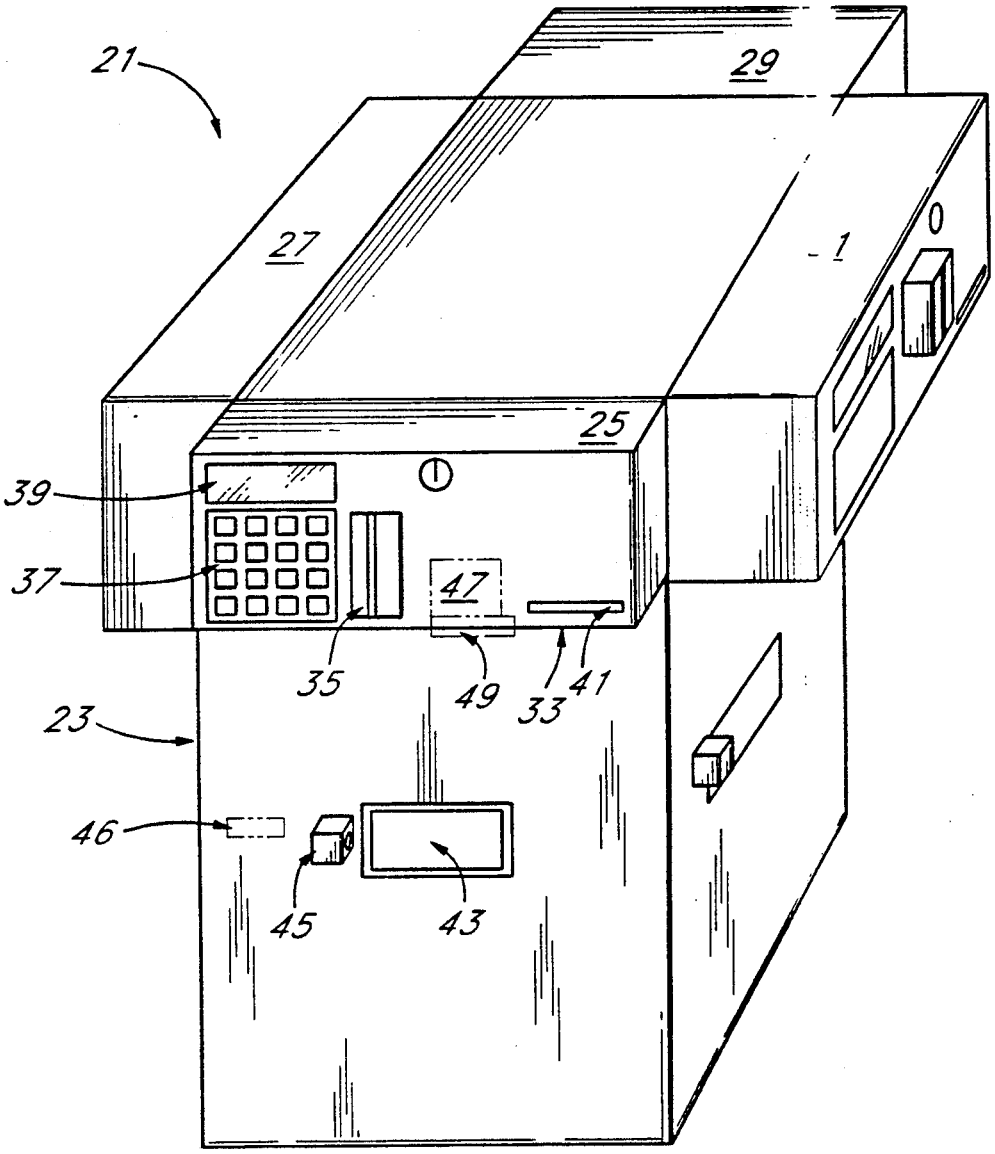
FIG. 1 is a perspective view of the article vending machine embodying the improved article handling system of the present invention.

Referring to FIG. 1, the preferred embodiment of the article dispensing machine is referred to generally with the numeral 21, and will be first explained in operation from the viewpoint of a customer-operator. The article dispensing machine 21 has a generally rectangular or square shaped base portion 23, and an overhanging portion at the upper end of each wall of the square shaped base portion 23, namely overhanging portions 25, 27, 29, and 31. Each of the four overhanging portions 25, 27, 29, and 31 has a nearly identical configuration, as does each side of the lower portion of base portion 23 With the design of the instant invention, each of the four sides of the article dispensing machine 21 may be operated by a customer-operator, such that the article dispensing machine 21 can accommodate up to four customer-operators simultaneously. This expanded accommodation is beneficial in serving many customers during peak demand operating hours.

In FIG. 1, the overhanging portion 25 is shown facing the reader, and has further features configured along its surface 33. A card type magnetic strip reader 35 is vertically oriented and is conveniently placed for use by the customer-operator A keypad 37 is located just to the left of magnetic strip reader 35. A screen 39 may be a recessed cathode ray tube, liquid crystal, or other dot matrix screen suitable for displaying alpha numeric characters to a customer-operator. Screen 39 is especially useful for providing a list or menu of the articles available to be dispensed. The overhanging portion 25 preferably forms a water proof NEMA 4 type enclosure which is easily accessible via a hinge (not shown). At the lower right of overhang portion 25 is a receipt access slot 41.

Beneath the overhang portion 25, an access door 43 is situated generally at the center of the base portion 23. Access door 43 is preferably operated under solenoid control To the left front of access door 43 is a single exterior ultraviolet sensor 45. To the left of the single exterior ultraviolet sensor 45 is an interior ultraviolet sensor 46 shown in phantom. The exterior ultraviolet sensor 45 works in conjunction with a laser scanning bar code reader 47, shown in phantom within the overhanging portion 25. The laser scanning bar code reader 47 is directed through a transparent window 49, also shown in phantom, and toward the area immediately in front of access door 43. The triggering of the exterior ultraviolet sensor 45 triggers the laser scanning bar code reader 47 mounted in overhanging portion 25 to scan downward through window 49. If a valid bar code is sensed, the access door 43 is vertically opened. The interior ultraviolet sensor 46 mounted directly behind and to the left of access door 43 makes an independent determination of the validity of an object being entered in the machine. If either the exterior ultraviolet sensor 45 or interior ultraviolet sensor 46 fails to detect an ultraviolet target, the access door 43 immediately closes, preventing a foreign article from being entered into the machine. This dual identification method is superior to barcode identification alone, and has the advantage of identifying a valid article prior to a user being able to gain access to the vending machine. The details and inner workings of the article dispensing machine 21 of the present invention follows.

Figure 2:
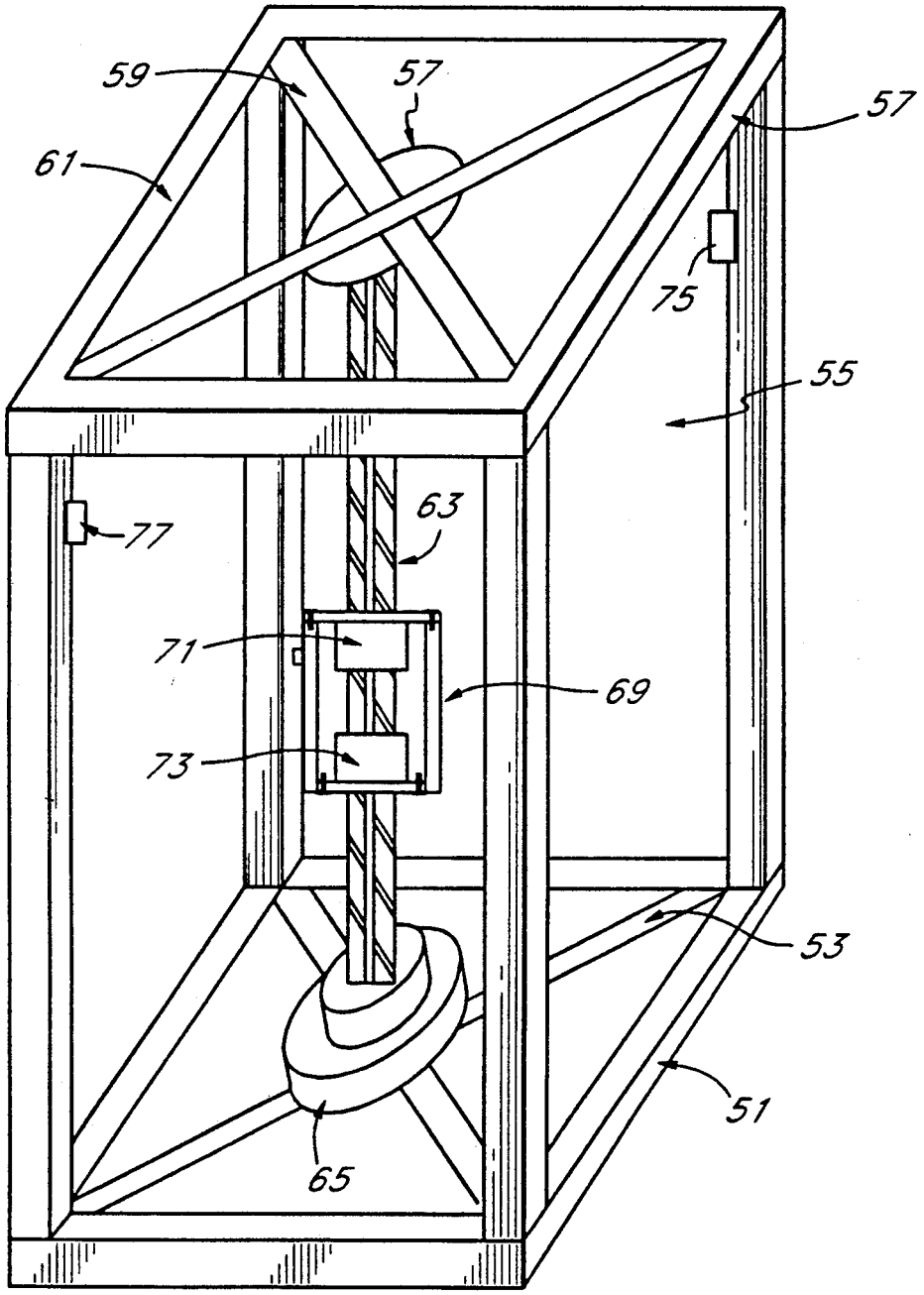
FIG. 2 is a perspective view of the frame of the article vending machine of FIG. 1, illustrating the main transport mechanism.

Referring to FIG. 2, the skeletal structure of article vending machine of the present invention is illustrated. A rectangular base support 51 having a pair of cross supports 53 supports four vertical supports 55 at the corners of the rectangular base support 51. A top support 57 is supported by the four vertical supports 55 and similarly has a pair of cross supports 59. The rectangular base support 51, cross supports 53, four vertical supports 55, top support 57, and cross supports 59 form a cage-like structure, or frame 61.

The improved article handling system uses a stationary splined ball screw 63 mounted to frame 61 via a bottom stationary mount 65 and a top stationary mount 67. The construction of the mounts 65 and 67 in conjunction with the construction of the frame 61 enables a ridged mounting configuration. About the splined ball screw 63 is centered a motor assembly 69. Motor assembly 69 consists of a screw nut 71 mounted over a spline nut 73. A photo switch 75 is mounted to a vertical support 55 and is aligned with a reflector 77 mounted on opposite vertical frame support 55.

Figure 3:
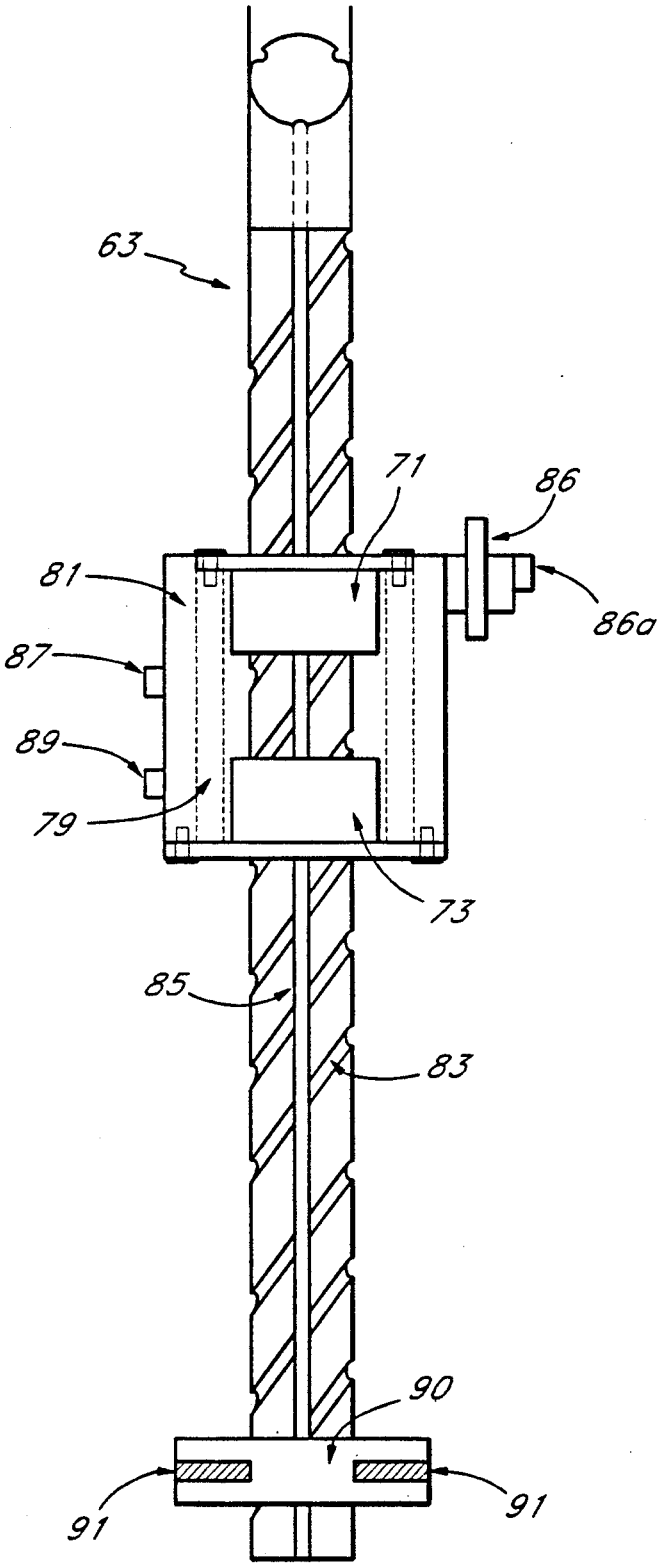
FIG. 3 is a front elevated view of the transport mechanism shown in FIG. 2 illustrating the accomplishment of two axes of motion utilizing a single motor.

Referring to FIG. 3, a more detailed view of the motor assembly 69 of FIG. 2 is illustrated. On each side of the motor assembly 69 is a concentrically inwardly located motor rotor 79, and a concentrically outwardly located motor stator 81. Motor rotor 79 rotates on a screw groove 83 via screw nut 71 to elevate or lower the motor assembly 69. Spline nut 73 moves up and down a straight vertical splined grove 85 to preventing the stator from twisting. A fail-safe solenoid 86 may be employed atop motor assembly 69 to mechanically disable movement of the motor assembly 69 in the event of a runaway. A magnetic reed switch 86a is strategically placed to detect the position of the fail-safe solenoid 86. Such a solenoid would cause a pin to be inserted between the rotor 79 and stator 81 to prevent their relative movement.

The wiring of the motor assembly 69 extends from a pair of ports 87 and 89. Port 87 is the power connection port for the motor assembly 69. Port 89 is a connection for a resolver. A resolver is a device which determines the position of the motor assembly 69 and feeds back a signal indicative of position to the circuitry for controlling the motor assembly 69. Such resolution may be relative or absolute, depending upon the type of overall control scheme employed. The wiring will be arranged with sufficient slack to permit motor assembly 69 to move vertically. Motor assembly 69 is the only moving member in the improved article handling system of the present invention.

A mechanical rubber ring stop 90 is located at the bottom of ball screw 63 to provide a safe stop. Rubber ring stop 90 is mounted to the splined ball screw 63 via set screws 91 and will stop the descent of carousel in the event of catastrophic runaway.

Figure 4A:
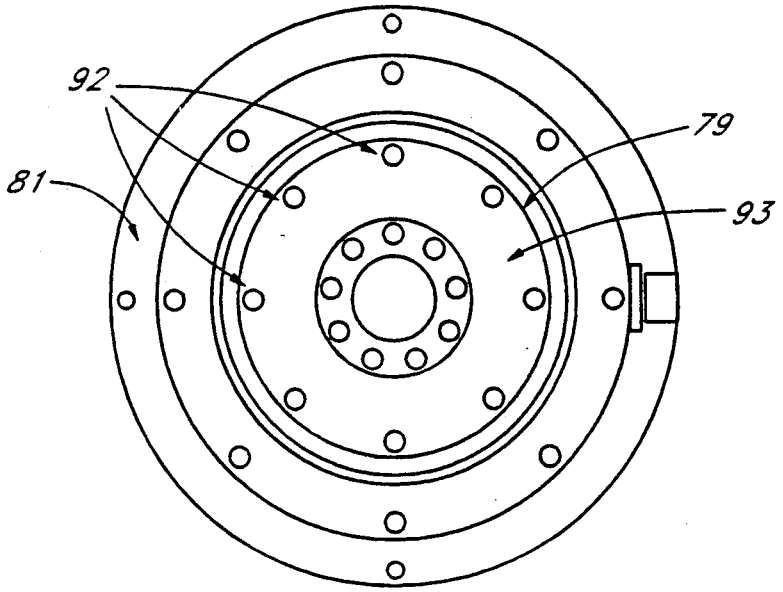
FIG. 4(*a*) is a view of the top surface of a first embodiment of a brushless DC motor utilized in the instant invention wherein a stator is on the outside while a rotor is on the inside.
Figure 4B:
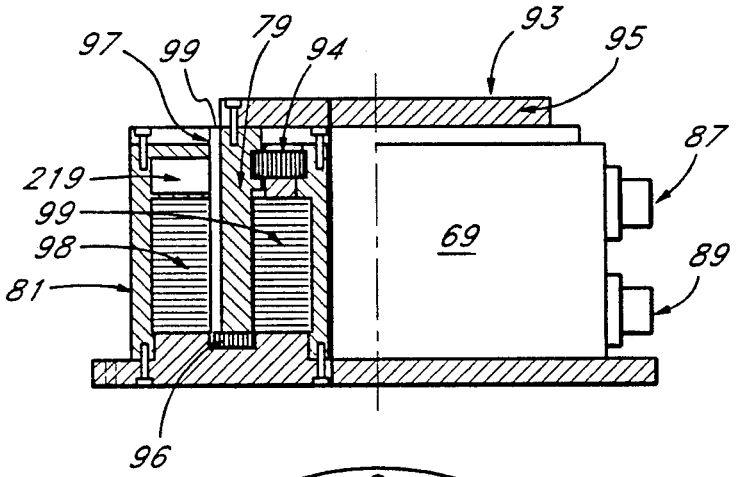
Figure 4C:
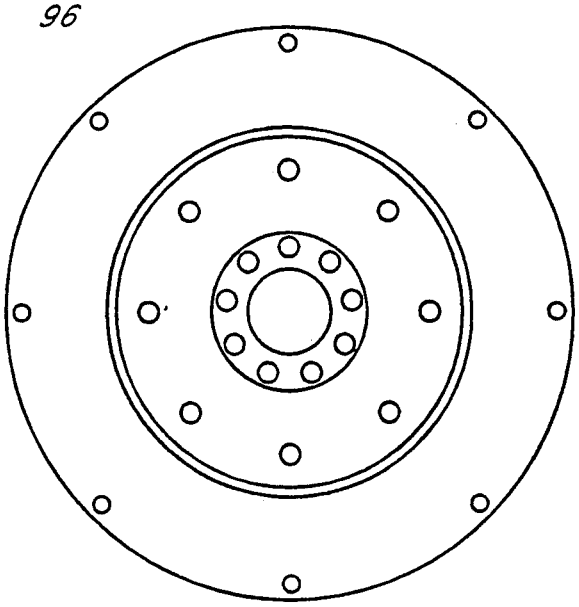

Referring to FIG. 4(*a*), a top view of a first embodiment of the motive portions of the motor assembly 69 illustrates stator 81 lying concentrically outside of rotor 79. Atop the rotor 79 are several output mounting holes 92. Output mounting holes 92 are typically threaded holes which are engineered to best handle and transmit the torque loads, from the rotor 79, resulting from operation of the motor assembly 69.

Referring to FIG. 4(*b*), a partially cut away side view of the motive portions of motor assembly 69 reveals the interface between the rotor 79 and the inner and outer stator 81. Rotor 79 is seen as having a surface 93, and a circumferentially raised land 95 along a portion of the surface 93. The surface 93 and land 95 form a complimentary fit with an internal surface 97 and an internal groove 99, respectively, of stator 81. The land 95/groove 99 bearing fit fixes the relative axial displacement of the rotor 79 with respect to the stator 81. A motor assembly 69 of this type is commercially available from NSK. Rotor 79 rotates on two precision roller bearings 94 and 96 when inner and outer stator coils 98 and 100 induce magnetic forces on rotor 79. Resolver 219 controls the commutation of the rotor 79 and angular displacement of rotor 79.

Referring to FIG. 4(*c*), a bottom view of the motive portions of the motor assembly 69 of FIGS. 4(*a*) and 4(*c*). A series of base mounting holes 101 surround the outer periphery of the stator 101. Base mounting holes 101 are also typically threaded holes which are engineered to best handle and transmit the torque loads, from the stator 81, resulting from operation of the motor assembly 69. A motor addembly 69 of this type is commercially available from Yokogawa company.

Figure 5A:
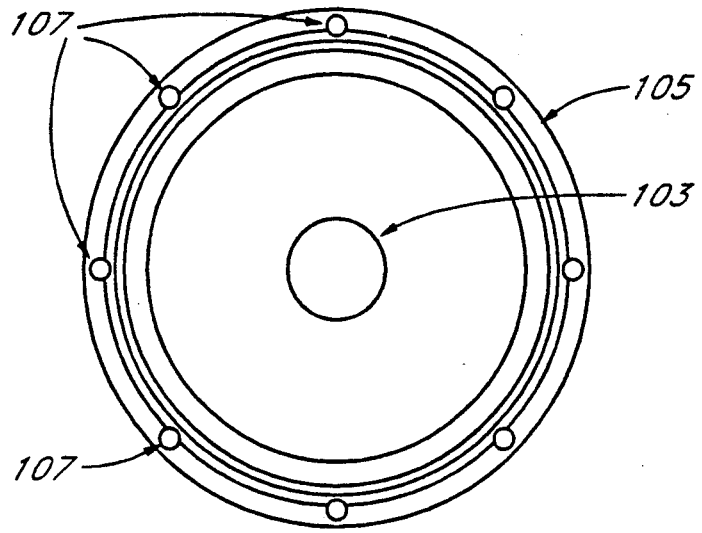
FIG. 5(*a*) is a view of the top surface of a second embodiment of a brushless DC motor utilized in the instant invention wherein a rotor is on the outside while a stator is on the inside.
Figure 5B:
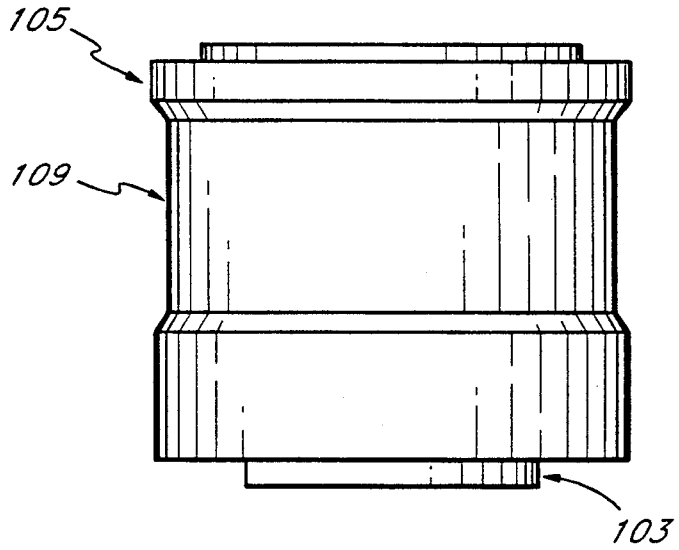
Figure 5C:
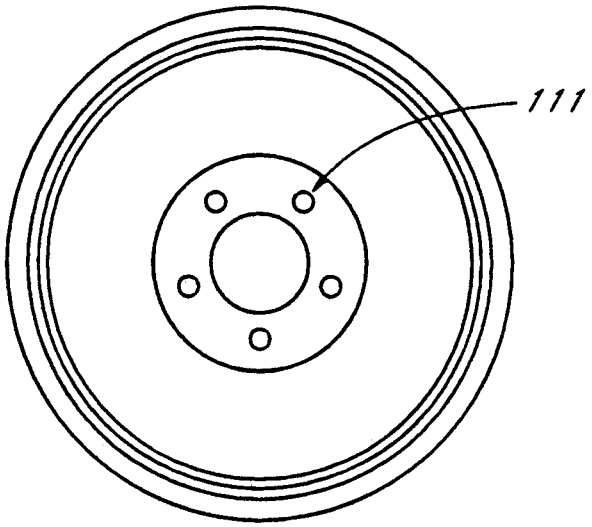
Figure 7A:
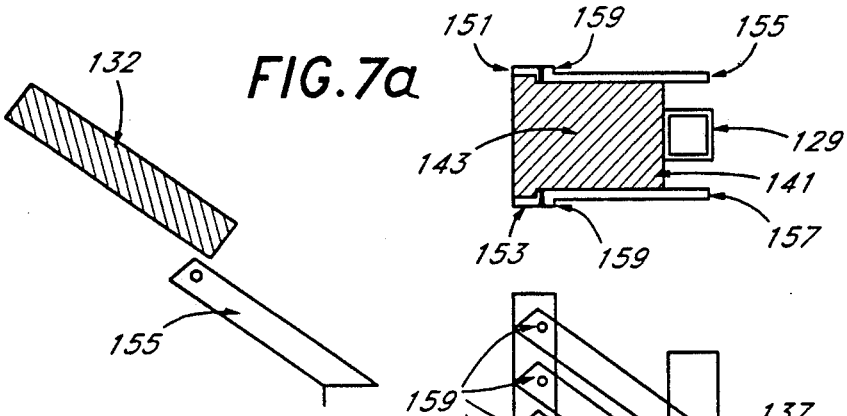
FIG. 7(*a*) is a top view of a single shelf and its attached shelf support.
Figure 7B:
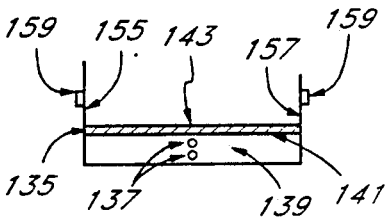
Figure 7C:
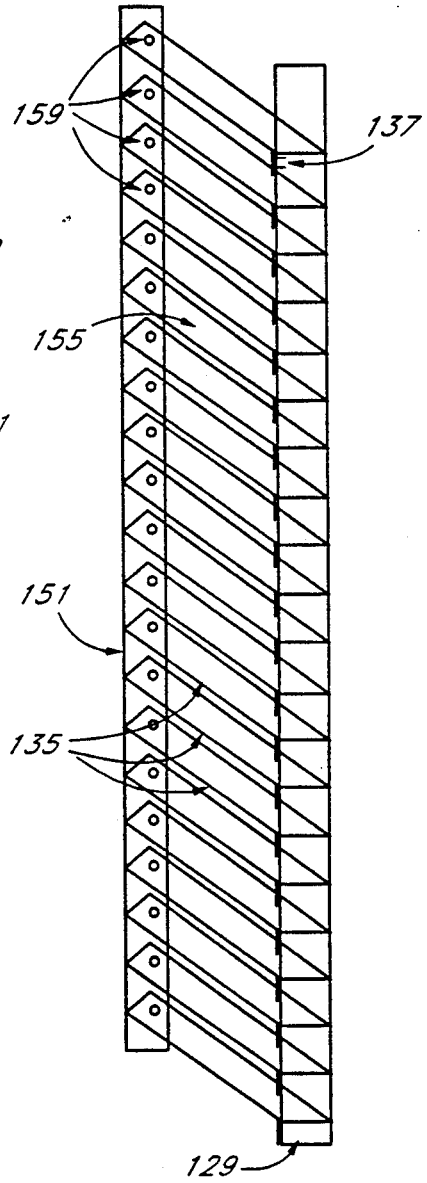
Figure 7D:
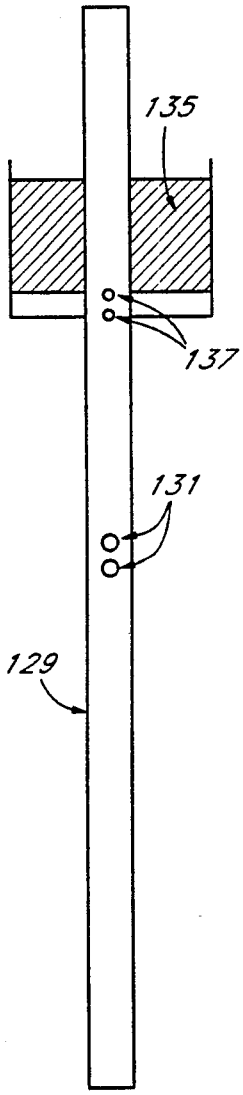

Referring to FIG. 5(*a*), a top view of a second embodiment of the motive portions of the motor assembly 69 illustrates a stator 103 lying concentrically within a rotor 105. Atop the rotor 105 are several upper housing mounting holes 107. Upper housing mounting holes 107 are typically threaded holes which are engineered to best handle and transmit the torque loads, from the rotor 105, resulting from operation of the motor assembly 69.

Referring to FIG. 4(*b*), a side view of the motive portions of motor assembly 69 reveals the relative diameters between the outer rotor 105 and the inner stator 103. Rotor 105 is seen as having an external surface 109. Stator 103 is partially seen extending axially away from the rotor 105.

Referring to FIG. 5(*c*), a bottom view of the motive portions of the motor assembly 69 of FIGS. 5(*a*) and 5(*c*). A series of base mounting holes 111 surround the outer periphery of the stator 103. Base mounting holes 111 are also typically threaded holes which are engineered to best handle and transmit the torque loads, from the stator 103, resulting from operation of the motor assembly 69.

Referring to FIGS. 6(*a*) and 6(*b*), both a top and side view, respectively, of a hub 121 illustrates its attachment to rotate with the rotor 79 of FIGS. 4(*a*)–4(*b*). As the hub 121 rotates with, and experiences angular displacement in the horizontal plane with the rotor 79, it rises or falls in elevation due to the stationary splined ball screw 63 about which the rotor 79 surrounds. Bolts 123 attach a center plate 125 of hub 121 to the rotor 79 via the output mounting holes 92 of FIG. 4(*a*). The hub 121 has a cross support 127 attaching the outer periphery of the of the hub 121 to the center plate 125. Center hole 124 allows hub 121 to rotate around while simultaneously moving vertically about stationary splined ball screw 63. A series of vertical shelf supports 129 are attached in an evenly spaced manner to the outwardly disposed surface of the hub 121, and completely around its periphery.

Preferably, the shelf supports 129 will be made of steel. Each shelf support 129 is affixed to hub 121 by a pair of bolts 137 which are extended radially outwardly through hub 121 and threaded in mating holes 133 on back of shelf supports 129. Alternately, rivets may be utilized. Note that the holes 131 on hub 121 are placed at a differing height along the surface of hub 121. This differential placement will be explained below.

Referring FIGS. 7(*a*)–7(*d*), and particularly to FIG. 7(*a*), a top view of shelf support 129 illustrates its location next to a shelf 135. Referring to FIG. 7(*b*), an end view of shelf 135 shows two rivets 137. The rivets 137 extend through a portion 139 of the surface of shelf 135 which is vertically oriented. From the vertically oriented portion 139, the shelf 135 ends upwardly through an angled transition 141 into an angled surface portion 143. The two rivets 137 through holes (not shown) in the vertical portion 139 of shelf 135, cause the shelf 135 to be mounted on the shelf support 129.

Referring to FIG. 7(*c*) a vertical column of 21 shelves 135 attached to a single shelf support 129 is illustrated. For rigidity, a pair of alignment rails 151 and 153 are attached to a pair of upper side edges 155 and 157 of each shelf 135 in the column of shelves. The attachment is accomplished with rivets 159, one such rivet 159 at each side of the upper portion hold all shelves common to a shelf support 129. The spacing of shelves 135 is critical and must equal either the lead of the groove 83 of the screw 63, or some multiple thereof. Proper spacing is to insure the proper placement of any individual shelf 135 as the hub 121, while turning, moves vertically into position with respect to the access door 43 of FIG. 1.

Referring to FIG. 7(*d*), a view circumferentially from within hub 121 illustrates the back of the shelf support 129, including the location of bolts 131 which hold the shelf support 129 in place with respect to hub 121, and including an exemplary set of rivets 137 which are shown attaching a single shelf 135 to the shelf support 129. Preferably, the main portion 143 of shelf 135 is inclined at an angle of 60°. The shelf 135 angle allows the article to gravity feed itself into the shelf 135 while allowing a secure transport when the hub 121 is rotated. The vertical portion 139 of shelf 135 should have a height of about an inch to ensure stability and adequate support.

Figure 8:
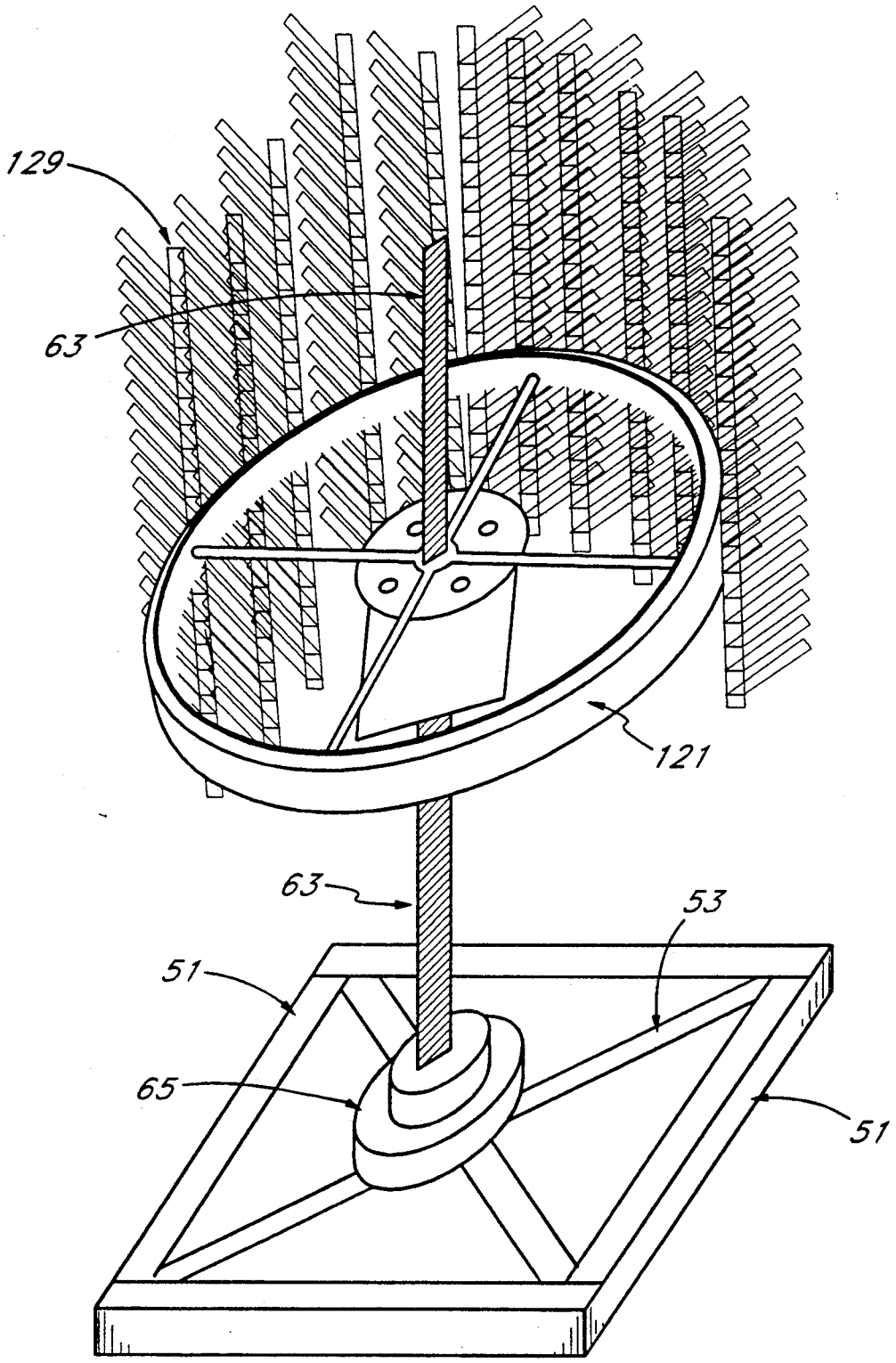
FIG. 8 is a sectional view of the shelves of FIG. 6 shown mounted to the shelf supports which are supported to a tape hub.

Referring to FIG. 8, a perspective view of the hub 121 supporting several sets of shelf supports 129, which in turn support several columns of shelves 135, is illustrated. For clarity, the shelf supports which would normally face the reader are removed. The configuration illustrated in FIG. 8 will accommodate 28 shelf supports 129 with 21 shelves 135 each, totaling a 588 shelves 135 permitting a 588 article capacity. The assembly totalling 588 shelves may be referred to as a carousel.

In FIG. 6, it was noted that the bolts 131 on hub 121 are placed at a differing height along the surface of hub 121. This differential placement is an advantageous construction in which the shelf support 129 mounting holes are placed strategically so that one complete revolution of the hub 121 allows for a rise equal to the height of one shelf 135. In this configuration, the width of the hub 121 must be adequate to structurally accomodate the rise in position of the shelf supports 129 throughout the complete perimeter of the hub 121. Alternately, mounting holes in each adjacent shelf support 129 would need to be differentially higher or lower. In this manner, the height of the hub may be quantitized, each angular displacement of the hub bringing an adjacent shelf 135 into proper position behind access door 43. This is so, regardless of which of the four access doors for each of the four sides in which a shelf 135 is brought into position. For access to a shelf 135, a single hub 121 height, combined with a single angular rotation will accomplish the access.

Figure 9A:
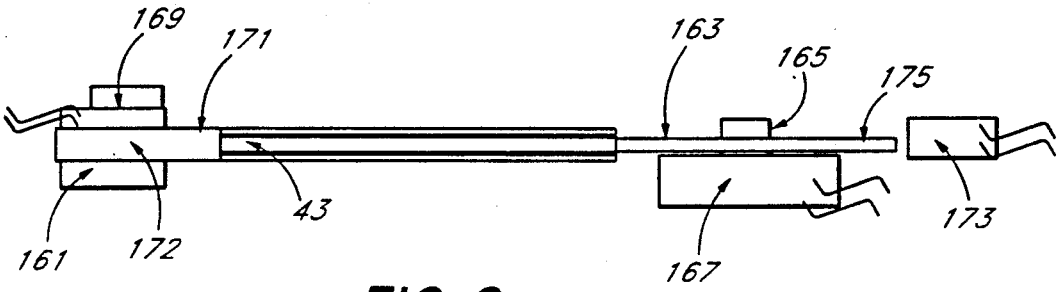
FIG. 9(*a*) is a top view of a tape door utilizable with the article vending machine of the present invention.
Figure 9B:
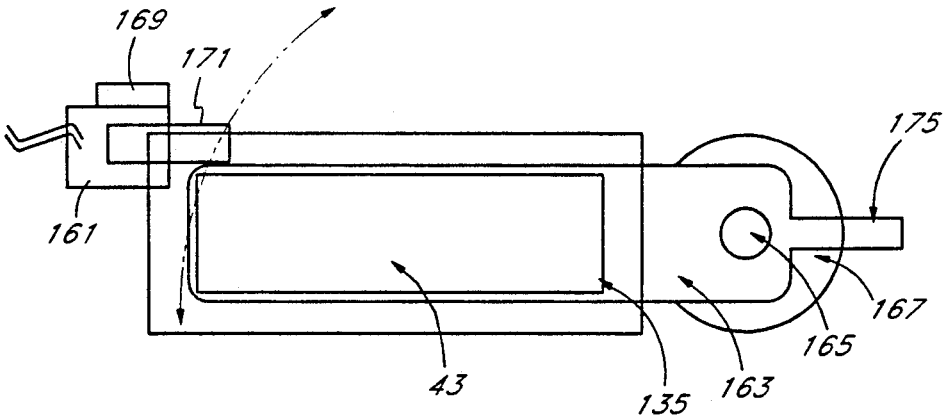

Referring to FIGS. 9(*a*) and 9(*b*), a top and front detailed view, respectively, is had of access door 43. The actual access door 43 may be made of glass or plastic, but will be of sufficient strength to prevent pilfering or improper interference by a customer-operator. The access door 43 swings open within a generally vertical plane. A door lock solenoid 161 is positioned adjacent the upper corner of the access door 43. A curved two headed arrow, in FIG. 9(*b*) illustrates the arc of swing of the access door 43.

Access door 43 has an extended portion 163 connected to a rotary solenoid shaft 165. The length of extended portion 163 controls the smallness of arc with which access door must move to completely uncover the area of access to the shelves 135 which lie within the article dispensing machine 21 with respect to a position outside the article dispensing machine 21. The rotary solenoid shaft 165, to which the extended portion 163 of access door 43 is attached, forms the axial center of a rotary solenoid 167. Electrical energization of the rotary solenoid 167 causes the cylinder to rotate about its axis, causing the access door 43 to pivot to the open position.

The locked status of the door may be monitored by the use of a magnetic reed switch 169 which senses whether the lock solenoid shaft 172 has extended, to thus prevent the vertical movement of door 43. Additionally, an inductive proximity sensor 173 may be used to detect the position of a door blade target 175. I FIGS. 9(*a*) and 9(*b*), the door blade target 175 is either continuous with or connected to extended portion 163 of access door 43. Increased methods for monitoring the position of access door 43, ensures the closure of access door 43 before movement of the hub 121 and its associated shelves 135.

Figure 10:
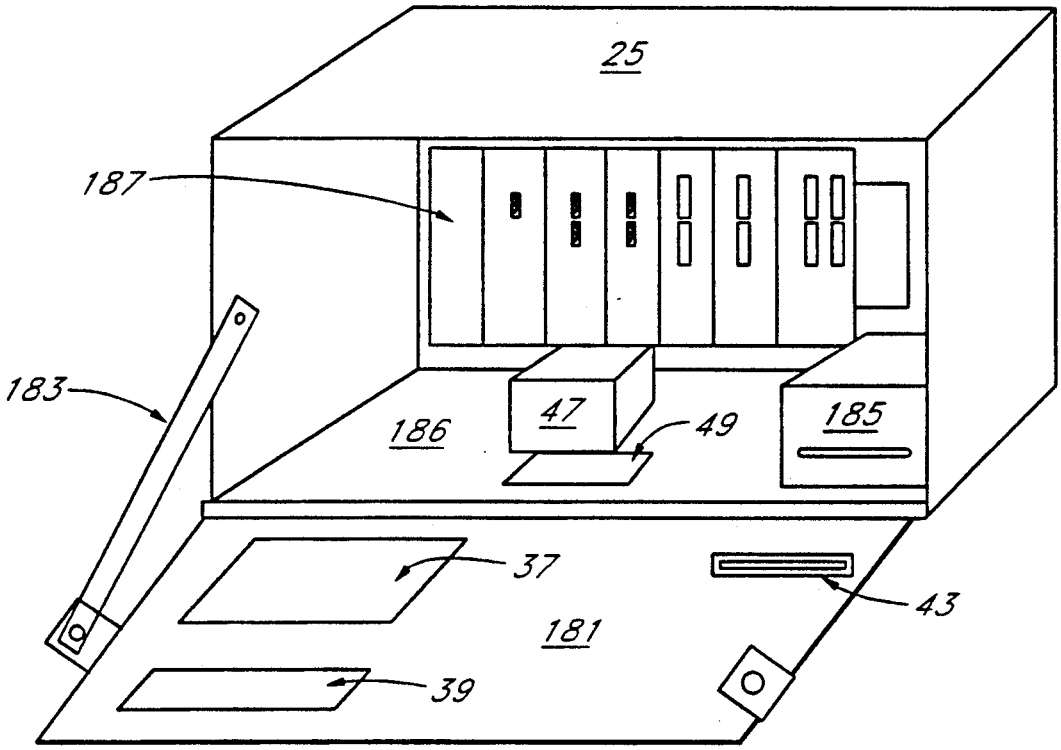
FIG. 10 is a perspective view of the internal components of the control console.

Referring to FIG. 10, a perspective internal view of the overhanging portion 25 of article dispensing machine 21 is illustrated. A service door 181, whose underside was surface 33 of FIG. 1, enables easy access to the internal space within overhanging portion 25. An extension strap 183 connects service door 181 with the internal area of overhanging portion 25 to limit the extent to which service door 181 may be opened, and to provide a flat support to facilitate any work needed to be performed on any of the structures within overhanging portion 25, such as the keypad 37 or the display 39.

A printer 185 is located to align with the receipt access slot 43 which was shown in FIG. 1. An industrial controller 187 forms the controlling heart of the article dispensing machine 21 of the instant invention. Industrial controller 187 may be formed of a myriad of different types of structures which are known in the controller field. Laser scanning bar code reader 47 is mounted on the bottom of the overhanging portion 25 and scans through the transparent window 49.

Figure 11:
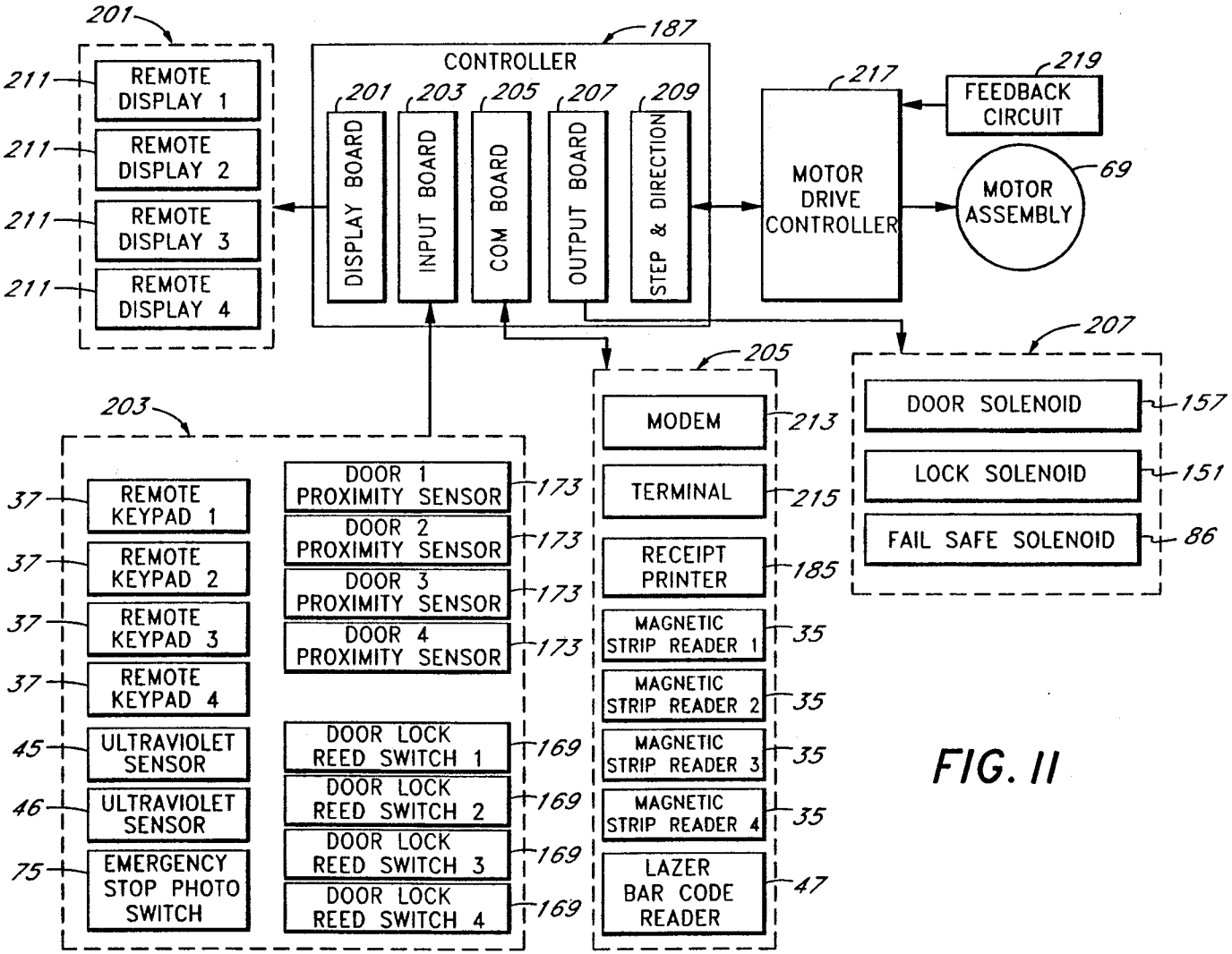
FIG. 11 is a block diagram schematic of one possible distributed computer control scheme of various aspects of the article dispenser of FIGS. 1-9.

Referring to FIG. 11, one possible control block diagram is illustrated. Industrial controller 187 is a central block which includes sub-blocks including a display board 201, an input board 203, a communications board 205, an output board 207, and a step and direction board 209.

Display board 201 further includes separate controls for a plurality of remote displays 211. In the embodiment of FIGS. 1–11, there are four such displays 211, each driving a screen 39. As previously discussed, each site of operation by a customer-operator, since there are four such sites in the embodiment of FIGS. 1–11, will involve a four times duplication of the control, display and other monitoring circuitry for each operating station.

Input board 203 receives inputs from the remote keypad 37, each of four magnetic reed switches 160, each of the four proximity sensors 163, and each of the four card type magnetic strip readers 35. Communications board 205 is connected to a modem 213 and terminal 215. The magnetic strip readers 35 and laser scanning bar code reader 47 are typically devices which communicate under the RS 232 protocol, and are connected to the communications board 205. Communications board 205 may be programmed to initiate contact with the credit card company when the customer-operator presents a credit card, may be programmed to report service problems to a remote location upon electrical or mechanical failure, and may even report an inventory and accounting summary to a business headquarters. The terminal 215 may serve as an interface between the communication card 205 and the modem 213.

Output board 207 outputs command signals to all portions of the article dispensing machine 21 except the motor assembly 69. Output commands are routed to the door rotary solenoid 167, and the lock solenoid 161. The receipt printer 185 typically operates under the RS 232 protocol and is connected to the communication board 205.

The step and direction board 209 is connected to a motor drive controller 217. Motor drive controller 217 is connected to motor assembly 69, as was previously shown through motor connector 87 of FIGS. 4(*a*)–4(*c*). A feedback circuit 219 is also connected to the motor drive controller 217 and to the motor assembly 69. Feedback circuit 219 either receives information on the absolute position of motor assembly 69, or keeps track on the relative position of motor assembly 69, and provides absolute feedback information on the position of motor assembly 69 to the motor drive controller unit 217 in order that precise control may be achieved.

Figure 12A:
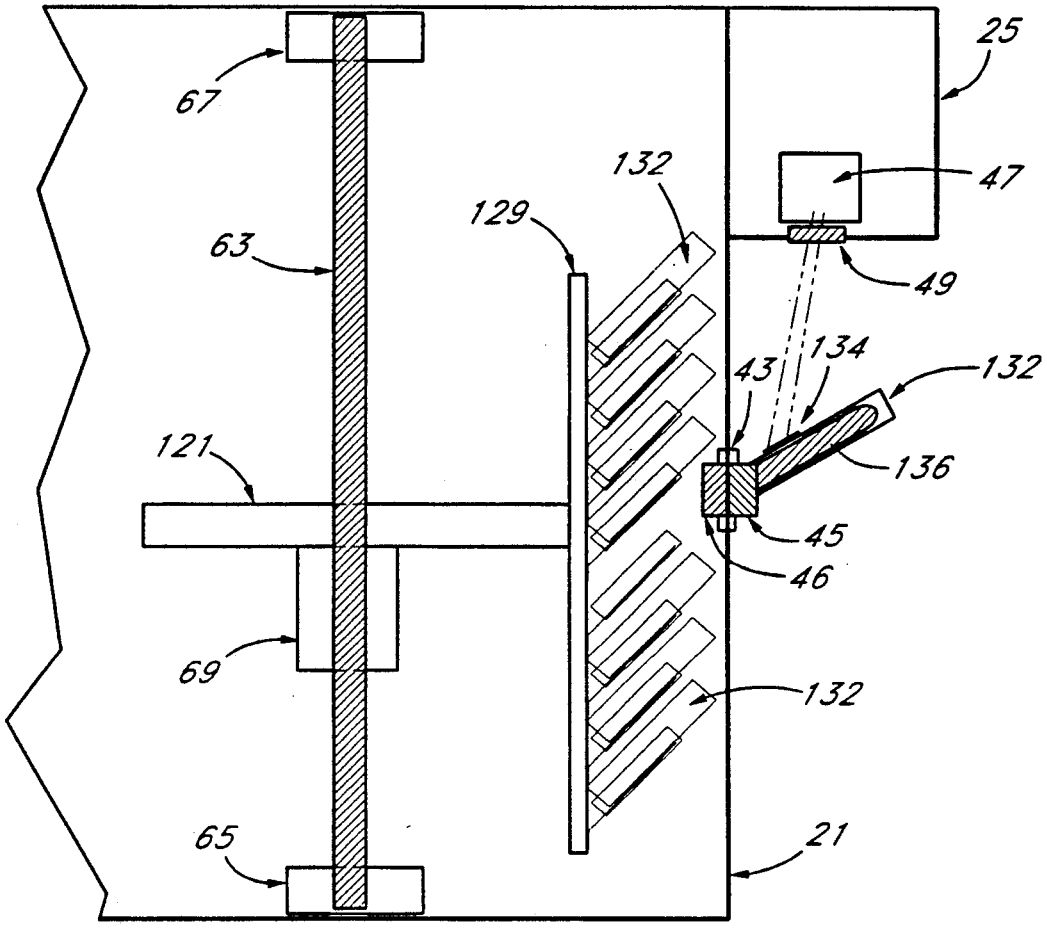
FIG. 12(*a*) is a side sectional view of the article vending machine illustrating the shelving, transport, and article identification structures.
Figure 12B:
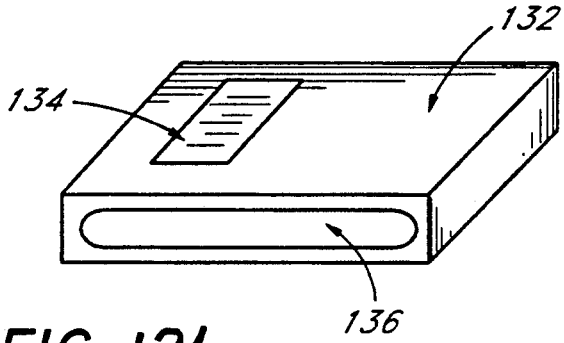

Referring to FIG. 12(*a*), a cutaway side view of the article dispensing machine 21 is shown. Adjacent the access door 43 of the article dispensing machine 21 is an exterior ultraviolet sensor 45 and an inside ultraviolet sensor 46. An article to be returned 132 is in position in front of access door 43, and having both a barcode label 134 on its upper surface, as well as ultraviolet paint 136, or other ultaviolet reflective substance, on its side surfaces. A laser scanning bar code reader 47 is located in the overhanging portion 25, and is shown scanning the barcode label 134 through a window 49. Thus, the article to be returned is illustrated as being multiply scanned. In this configuration, the multiple use of both barcode and ultraviolet identification to positively verify the identity of the article being returned will reduce the chance of the improper return of the articles, and/or vandalism against the article dispensing machine 21.

Referring to FIG. 12(*b*), a detail of the article to be returned 132 illustrates an improved detail of the bar code label 134 and the ultraviolet paint 136, or other ultraviolet reflective structure.

Figure 13:
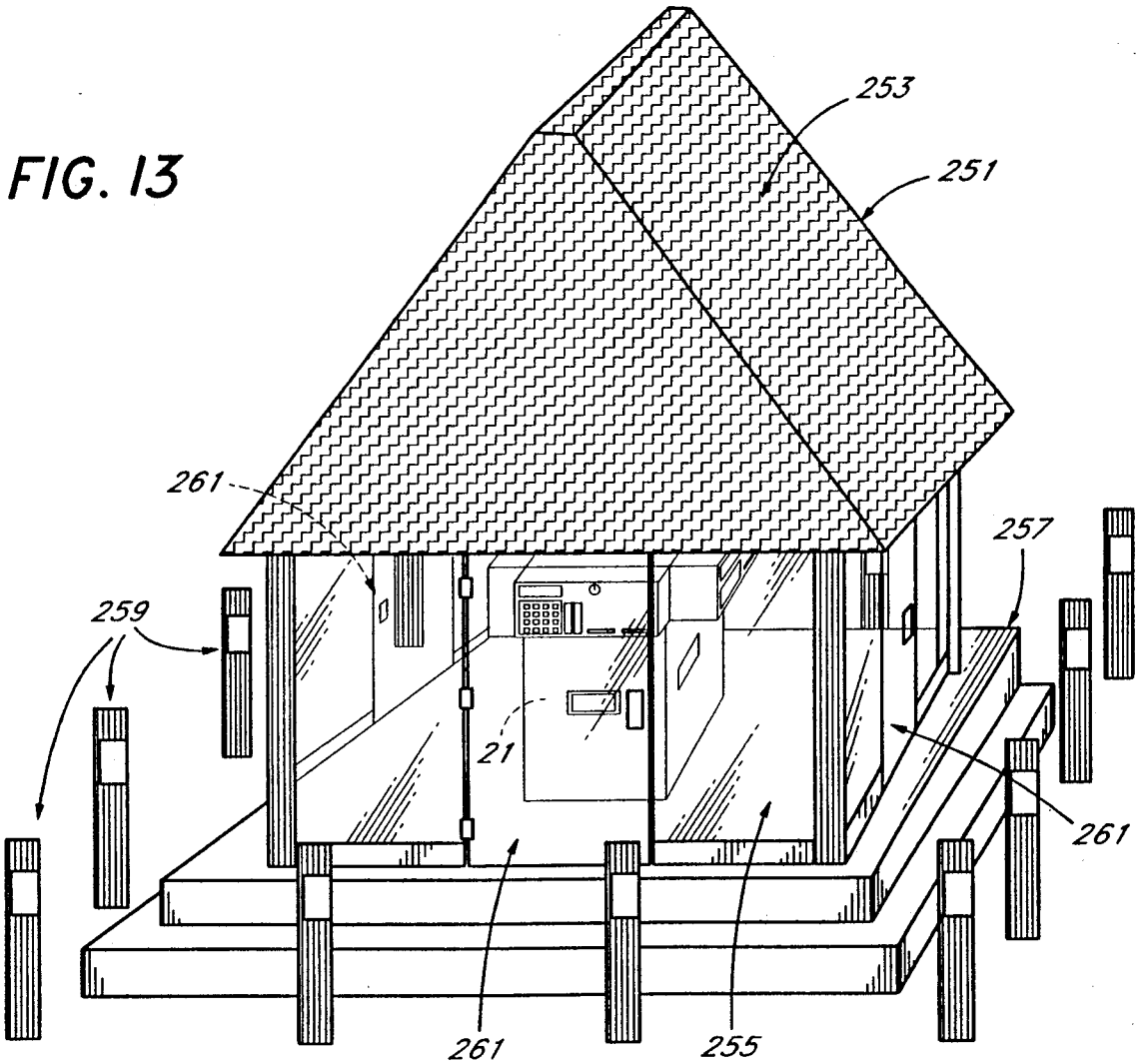
FIG. 13 illustrates a perspective view of the article dispensing apparatus of the present invention housed within an outside freestanding kiosk.

Referring to FIG. 13, a perspective view of one possible stand alone configuration for the article dispensing machine 21 of the present invention is illustrated. An outdoor kiosk 251 includes a roof 253 and transparent glass sides 255. The kiosk 251 stands atop a tiered platform 257, the tiers forming steps. A series of illumination posts 259 are positioned along the outer portion of the tiered platform 257 for illuminating kiosk 251. The glass sides 255 each define a door 261. Each door 261 opens directly onto a customer-operator overhanging portions 25, 27, 29, or 31, and its associated access door 43. In the configuration of FIG. 13, the article dispensing machine 21 can operate 24 hours per day, in a well lighted and secure environment which is protected from the weather. In the configuration just described, the transactions would be according to credit card, or some other type of accounting card. Therefore, robbery, as an incentive to vandalize the article dispensing machine 21 would be removed. The internal portions of article dispensing machine 21 can be made quite secure, so that even if the machine were to be vandalized, the chances of losing the vended articles would be minimal. In addition, the control circuitry and modem which was utilized for credit card authorization can also be used for security notification. Surveillance cameras and automated initiation of distress messages could also be employed.

The operation of the article dispensing machine 21 of the present invention is as follows. On system power up, the home position of the hub 121 is automatically found using a stall detection system. The home position is the furthest down position of the motor assembly 69 on the stationary splined ball screw 63. When the motor assembly 69 homes, the motor assembly 69 will slowly travel downward. When the mechanical rubber ring stop 90 is reached the motor assembly 69 will stall under its current limit. This stall is detected by comparing the signal from the feedback circuit 217 with the control signal from the motor drive controller 217. Since the motor assembly 69 would be stalled, signal representing a change in feedback state would be received, even though a motor command signal is being sent from the motor drive controller 217. The machine then readies itself for the next transaction by moving a known distance to the closest empty bin location from the vertical center of the carousel, with respect to the access door 43. This innovative means to detect home, with an average maximum of three quarters revolution of the hub 121, or carousel, eliminates the need for an external home sensor.

Shutdown also may be needed in the event of motor runaway in the upward direction. The photo switch 75 mounted to inside of one of the four vertical supports 55 detects reflector 77 mounted on opposite vertical support 55. In the event of motor runaway the upper portion of the shelves 135 will break the photo beam. The photo switch 75 is connected to disabling the motor drive controller 217. If the photo switch 75 is tripped, the fail safe solenoid 86 will immediately activate.

As an additional safety feature, on power loss there is a possibility for the carousel to uncontrollably rotate downward with gravity. To prevent this, the spring activated fail safe solenoid 86 locks the motor assembly 69 to prevent further movement. A magnetic reed switch 86a detects the retraction of this solenoid to prevent jamming of rotor in normal operation.

Once the article vending machine of the present invention has attained steady state, it is ready to perform vending activities. To operate the machine to rent or purchase an article from the machine, the customer-operator slides an ID card, such as a credit card or bank ATM(automatic teller machine) card, through the card type magnetic strip reader 35. The customer-operator may then be required enters Personal Identification Number via keypad 37, especially if the card utilized is not a credit card, or if greater customer security is required. The article dispensing machine 21 will then go on line, via the modem 213, and verify the card identity and Personal Identification Number. After ID verification, if required, machine access is permitted.

The customer-operator via keypad 39 can then select a rental, return or sale of article. The industrial controller 187 will be programmed to give the proper menus to the customer-operator and command the proper responses from the article dispensing machine 21 of the present invention. The appropriate transaction is recorded and a receipt is delivered to customer via a receipt printer 185. The access door 43 opens and an article resting upon shelf 135 is now available for direct removal by customer-operator.

The article dispensing machine 21 of the present invention incorporates an "Express Return" function to eliminate the necessity for card insertion or keypad entry by the operator in the returning of a vended article. To return an article, the article is placed in front of the closed access door 43. Exterior ultraviolet sensor 45 detects the ultraviolet paint 136 which signals laser scanning bar code reader 47 to scan for bar code 134.

The presence of both the ultraviolet paint 136 and bar code 134, which is found to be legitimate, confirms the identification of the article, and opens the access door 43. The article is then delivered into proper shelf 135. The access door 43 stays open as long as the ultra violet sensors 45 and 46 continue to detect the presence of ultraviolet material. This unique dual identification method eliminates the need to "reject" a foreign unidentified article from a machine once such an article has been placed within the machine. All customer identification is performed using the barcode 134 on the article to be returned 132, and performing a look up of the identity of the user who initially rented or was vended the article to be returned 132, to reduce the transaction time. The article dispensing machine 21 of the present invention will never accept an unidentified article. Due to the dual method of article identification of exterior ultraviolet sensor 45, interior ultraviolet sensor 46, and laser scanning bar code reader 47, the article is positively identified before machine access is permitted. Bar code identification alone is not sufficiently secure due to label tampering and the advent of special copying machines which can duplicate bar codes. The article to be returned will have an ultra violet presence sensor permanently affixed, or will be housed in a container made of ultraviolet material, to eliminate the possibility of removal of the ultraviolet tag.

When the article to be returned is placed in front of the access door 43, exterior ultraviolet sensor 45 detects the ultraviolet paint or other ultraviolet material 136, signalling the laser scanning bar code reader 47 to read the bar code 134. A good read triggers the door solenoid 167 to immediately raise the access door 43. The article dispensing machine 21 may be programmed to signal an access door 43 closure after a short delay during which there is no sensed ultraviolet material present by either the exterior ultraviolet sensor 45 or the interior ultraviolet sensor 46 to help prevent the deposit of foreign objects into article dispensing machine 21. Once the access door 43 is closed, the door locking solenoid 161 prevents the access door 43 from being forcibly opened. The article dispensing machine 21 of the present invention therefore presents a significant improvement over previously known vending machines.

Other important features include the above described "Express Return" feature, whereby the article dispensing machine 21 immediately accepts an article to be returned 132 without the need for keypad or magnetic strip card insertion. In the idle time between operator transactions, the carousel returns to the closest empty bin, or shelf 135 to the vertical center of one of the customer access points, to thereby reduce, on average, the maximum transaction time for the next transaction. At most, to return an article, the hub 121, will have to move ¾ of a revolution to place the empty shelf 135, which was previously centered at one of the four user positions, in alignment with one of the four user access doors 43 which is demanding a return. When the article vending machine is not being operated for a significant time, an energy saving mode is incorporated into the control mechanism wherein the motor winding excitation is reduced to 50%. This reduction is just sufficient to hold the carousel in place. Full current excitation resumes upon card entry or the sensing of an article to be returned 132.

As stated previously the article dispensing machine 21 is easily adaptable to Video games and audio laser discs with little or no machine modification. The presence of inserts (not shown), having a shape complimentary to the smaller article to be vended, onto the shelves 135 will make them adaptable to above mentioned articles.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. An article dispensing machine comprising:

a housing;

a carousel located within said housing and supporting a plurality of shelves, said carousel adapted for vertical and horizontal displacement, and wherein said carousel further comprises;

a center plate supported by said vertical elevation means;

a plurality of radially extending supports connected to said center plate;

a circular hub supported by said plurality of radially extending supports; and a plurality of shelf supports attached to said circular hub, each of said shelf supports supporting a plurality of shelves;

a pair of alignment rails for each said shelf support, each one of said alignment rails connecting one outer side of each said plurality of shelves;

vertical elevation means, supporting said carousel, for controlling the vertical and angular displacement of said carousel; and means for providing selective access to said shelves.

2. The article dispensing machine of claim 1 wherein said vertical elevation means further comprises:

a bottom stationary mount supported by said housing;

a top stationary mount supported by said housing;

a stationary splined ball screw having two ends, and supported at one end by said bottom stationary mount and supported at the other end by said top stationary mount;

a motor assembly surrounding said stationary splined ball screw, and supporting said carousel; and control means, electrically connected to said motor assembly, for controlling said motor assembly.

3. The article dispensing machine of claim 2 wherein said control means further comprises:

a step and direction controller, programmed to control said motor assembly;

a motor drive controller, electrically connected to said step and direction controller, and to said motor assembly, for providing the driving energy to said motor; and a feedback circuit, electrically connected to said motor assembly and to said motor drive controller.

4. The article dispensing machine of claim 2 wherein said control means further comprises:

a controller;

communications means, connected to said controller, for receiving communications from a customer-operator of said article dispensing machine and communicating with a location other than a location of said article dispensing machine;

display means, connected to said controller, for sending communications to said customer-operator of said article vending machine;

status sensing means, connected to said controller, for sensing the status of said article vending machine; and access control means, connected to said controller, for controlling the access which said customer-operator has with respect to said article dispensing machine.

5. The article dispensing machine of claim 4 having a plurality of display means and access control means, for serving a plurality of customer-operators.

6. The article dispensing machine of claim 4 wherein said access control means further comprises:

an access controller;

a magnetic strip reader, electrically connected to said access controller, for identifying information of said customer-operator;

a keypad, electrically connected to said access controller, for inputting information from a customer-operator;

at least one ultraviolet sensor, electrically connected to said access controller, for identifying returned dispensed articles; and a laser scanning bar code reader electrically connected to said access controller, for identifying returned dispensed articles.

7. The article dispensing machine of claim 1 wherein said plurality of shelves are inclined downwardly in the direction of the center of said carousel at an angle of about 60°.

8. The article dispensing machine of claim 1 wherein each of said plurality of shelves is slightly vertically displaced from an adjacent laterally located shelf.

9. The article dispensing machine of claim 1 wherein each of said plurality of shelf supports is slightly vertically displaced from an adjacent laterally located shelf support.

10. An article dispensing machine comprising:

a housing;

a carousel located within said housing and supporting a plurality of shelves, said carousel adapted for vertical and horizontal displacement;

vertical elevation means, supporting said carousel, for controlling the vertical and angular displacement of said carousel said vertical elevation means further comprising:

a bottom stationary mount supported by said housing;

a top stationary mount supported by said housing;

a stationary splined ball screw having two ends, and supported at one end by said bottom stationary mount and supported at the other end by said top stationary mount;

a motor assembly surrounding said stationary splined ball screw, and supporting said carousel, said motor assembly further comprising:

a motor rotor surrounding said stationary splined ball screw; and a motor stator surrounding said motor rotor;

control means, electrically connected to said motor assembly, for controlling said motor assembly and means for providing selective access to said shelves.

11. An article dispensing machine comprising:

a housing;

a carousel located within said housing and supporting a plurality of shelves, said carousel adapted for vertical and horizontal displacement;

vertical elevation means, supporting said carousel, for controlling the vertical and angular displacement of said carousel and further comprising:

a bottom stationary mount supported by said housing;

a top stationary mount supported by said housing;

a stationary splined ball screw having two ends, and supported at one end by said bottom stationary mount and supported at the other end by said top stationary mount;

a motor assembly surrounding said stationary splined ball screw, and supporting said carousel; and control means, electrically connected to said motor assembly, for controlling said motor assembly and further comprising:

a controller;

communications means, connected to said controller, for receiving communications from a customer-operator of said article dispensing machine and communicating with a location other than a location of said article dispensing machine;

display means, connected to said controller, for sending communications to said customer-operator of said article vending machine;

status sensing means, connected to said controller, for sensing the status of said article vending machine; and access control mans, connected to said controller, for controlling the access which said customer-operator has with respect to said article dispensing machine, said access control means further comprising:

an access door, displaceable between an open and a closed position;

a door lock solenoid engagable with said access door when said access door is in the closed position; and a rotary solenoid supported by said housing and pivotally supporting a rotary solenoid shaft, the rotary solenoid shaft attached to said access door, said access door pivotally displaceable with said rotary solenoid shaft; and means for providing selective access to said shelves and wherein said article dispensing machine has a plurality of display means and access control means, for serving a plurality of customer-operators.

12. The article dispensing machine of claim 11 having a plurality of access control means and wherein each access door is at a slightly different vertical height.

13. The article dispensing machine of claim 11 wherein said access control means further comprises:

an extended portion of said access door extending beyond said rotary solenoid shaft opposite the extension of said access door from said solenoid shaft; and an inductive proximity sensor, located proximate to said extended portion of said access door when said access door is in the closed position, and away from said extended portion of said access door when said access door is in the open position.

14. The process of dispensing and returning an article comprising the steps of:

inserting an identification card into a magnetic strip reader;

identifying an article, which is to be dispensed, to the controller of an article dispensing machine having an access door;

angularly and vertically displacing a carousel having a plurality of shelves, to align the article with the access door; and opening the access door to make the article available to the customer-operator;

placing the article in front of the access door;

sensing ultraviolet light from said article;

reading a laser scanned bar code on said article;

confirming the identification of the article, utilizing said sensed ultraviolet light and scanned bar code;

aligning an empty shelf with the access door; and opening the access door, to permit the article to be placed in the empty shelf.

* * * * *